US012459026B2

(12) United States Patent
Rukat

(10) Patent No.: US 12,459,026 B2
(45) Date of Patent: Nov. 4, 2025

(54) MODULAR CAN BODYMAKER

(71) Applicant: CROWN PACKAGING TECHNOLOGY, INC., Alsip, IL (US)

(72) Inventor: Bronislaw Rukat, West Yorkshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 16/318,901

(22) PCT Filed: Jul. 3, 2017

(86) PCT No.: PCT/GB2017/051952
§ 371 (c)(1),
(2) Date: Jan. 18, 2019

(87) PCT Pub. No.: WO2018/020209
PCT Pub. Date: Feb. 1, 2018

(65) Prior Publication Data

US 2019/0232351 A1 Aug. 1, 2019

(30) Foreign Application Priority Data

Jul. 28, 2016 (GB) ..... 1613053

(51) Int. Cl.
*B21D 22/28* (2006.01)
*B21D 51/26* (2006.01)

(52) U.S. Cl.
CPC ..... *B21D 22/283* (2013.01); *B21D 51/26* (2013.01)

(58) Field of Classification Search
CPC ..... B21D 22/283; B21D 22/22; B21D 22/24; B21D 22/20; B21D 51/26; B21D 51/22; B21D 51/18; B21D 51/2669; B21D 51/2692; Y10T 29/49778; Y10T 29/49764; Y10T 29/4978; B23Q 1/0072; B23B 31/1071; B23B 31/071
USPC ..... 72/347, 348, 349
See application file for complete search history.

(56) References Cited

U.S. PATENT DOCUMENTS

| | | | | |
|---|---|---|---|---|
| 3,735,629 | A | 5/1973 | Paramonoff | |
| 3,771,345 | A | 11/1973 | Paramonoff | |
| 3,943,740 | A | 3/1976 | Bartenstein | |
| 4,385,555 | A * | 5/1983 | Meloncelli | A01F 15/14 100/19 R |

(Continued)

FOREIGN PATENT DOCUMENTS

| | | | | |
|---|---|---|---|---|
| CN | 103687680 | A | 3/2014 | |
| DE | 102006043959 | A1 * | 3/2008 | B23B 31/1071 |

(Continued)

*Primary Examiner* — Jared O Brown
(74) *Attorney, Agent, or Firm* — Condo Roccia Koptiw LLP

(57) ABSTRACT

A can bodymaker comprising a plurality of components that require relative alignment to one another. The can bodymaker comprises a toolpack module which includes a toolpack frame and components including one or more dies supported by the toolpack frame. The die(s) are alignable with respect to the toolpack frame when the toolpack module is not attached to the bodymaker. The can bodymaker further comprises a fixing that allows removable fixing of the toolpack module to the can bodymaker.

17 Claims, 7 Drawing Sheets

(56) References Cited

U.S. PATENT DOCUMENTS

| | | | | |
|---|---|---|---|---|
| 2006/0086170 | A1* | 4/2006 | Zauhar | B21D 22/28 72/349 |
| 2012/0304720 | A1 | 12/2012 | Fleischer et al. | |
| 2015/0343516 | A1* | 12/2015 | Schremmer | B21D 22/28 72/349 |

FOREIGN PATENT DOCUMENTS

| | | | |
|---|---|---|---|
| JP | 58-99706 | A | 6/1983 |
| JP | 6-210382 | A | 8/1994 |
| JP | H08-39159 | A | 2/1996 |
| JP | 2016-104495 | A | 6/2016 |
| WO | WO 99/34942 | A1 | 7/1999 |

* cited by examiner

PRIOR ART

MODULAR CAN BODYMAKER

CROSS-REFERENCE TO RELATED APPLICATIONS

This application is the National Stage of International Application No. PCT/GB2017/051952 filed Jul. 3, 2017, which claims the benefit of GB application number 1613053.6, filed Jul. 28, 2016, the disclosures of which are incorporated herein by reference in their entirety.

TECHNICAL FIELD

The present invention relates to a modular can bodymaker. The invention also relates to a method of setting up a modular can bodymaker and to modules for a modular can bodymaker.

BACKGROUND

In known bodymakers for the production of thin-walled metal cans by the so-called "drawing and wall-ironing" (DWI) process, cups are fed to the bodymaker and carried by a punch, on the end of a reciprocating ram, through a series of dies to obtain the desired size and thickness of the can. The series of dies may include a redraw die, for reducing the diameter of the cup and lengthening its sidewall, and one or more ironing dies for wall-ironing a cup into a can body. Ultimately, the can body carried on the punch may contact a bottom forming tool or "domer" so as to form a shape such as a dome on the base of the can.

WO9934942 provides an example of a known bodymaker, which is shown schematically in FIG. 1. The known bodymaker 1 comprises a frame 2 which supports a tool pack 5 and drive mechanism 10. The drive mechanism comprises a gearbox (not shown) and a first action assembly which includes a ram 12, lever arm 14 and crank shaft 16. Rotation of the crank shaft 16 moves the ram/punch 12 into and out of the tool pack 5. Die pack assembly 20 comprises tool pack 5 and a second action assembly which includes a blank holder mounted on a crosshead 24 which is connected to push rods 26 (shown cut away in FIG. 1) and spreader plate/levers 28. A cam follower 30 on lever 28 engages a cam 32 on the crank shaft 16. The die pack assembly 20 and drive mechanism 10 are separated from each other by primary bulkhead 40 and seal pack 42.

Reconfiguring known bodymakers, such as the bodymaker described above, to produce cans of a different diameter is a time consuming process and typically takes more than eight hours to complete. During the changeover, production must be halted to replace the tooling in the bodymaker and to realign the bodymaker components for the new can diameter.

The high volume nature of the can industry means that any lost production time can be very costly for can producers. Additionally, the duration of the changeover means that manufacturing flexibility is reduced. For example, can producers may be reluctant to reconfigure the bodymaker for short production runs.

SUMMARY OF THE INVENTION

According to a first aspect of the present invention there is provided a can bodymaker comprising a plurality of components that require relative alignment. The can bodymaker comprises a toolpack module which includes a toolpack frame and components including one or more dies supported by the toolpack frame. The die(s) are alignable with respect to the toolpack frame when the toolpack module is not attached to the bodymaker. The can bodymaker further comprises a fixing that allows removable fixing of the toolpack module to the can bodymaker.

The die may be a (re)draw die or an ironing die, with one or more of a draw die, ironing die, a cup holder, a redraw sleeve and a stripper also being provided, coupled to and alignable to the toolpack frame.

The toolpack module may comprise a pair of wear bars attached to the toolpack frame and arranged to support said one or more dies. The die(s) are alignable with respect to the toolpack frame by adjusting one or both of said wear bars.

The toolpack module may comprise a redraw sleeve module configured to align a redraw sleeve with the toolpack frame. The redraw sleeve module is coupled to the toolpack frame and has one or more bearings defining a passage through which the redraw sleeve moves. The redraw sleeve module has a bearing adjustment mechanism to facilitate radial alignment of the redraw sleeve module with the toolpack frame.

The can bodymaker may comprise one or more further modules, each further module having one or more of said components coupled to a further frame and being alignable with respect to the further frame when the further module is not attached to the bodymaker. The can bodymaker then further comprises a further fixing for each further module that allows removable fixing of the further module to the can bodymaker. The further module may be a domer module with a bottom forming tool.

The fixing(s) may be quick release fixings allowing for a quick changeover of the module(s). The fixing(s) may be a single-point fixing, for example a zero-point clamp. The fixing may provide a positional accuracy better than 10 μm, preferably better than 5 μm for removably fixing each module to the bodymaker.

Each module may be removably fixed to the can bodymaker in a datum position which provides a reference position for aligning the other components of the bodymaker. The can bodymaker may comprise a fixing or fixings which allow the module to snap into place at the datum position such that no further alignment of the module with respect to the bodymaker may be necessary. The module remains locked in place during operation of the bodymaker. There may be multiple datum positions for different configurations of the bodymaker.

The can bodymaker may comprise an infeed-discharge module for delivering cups or other preform articles to the toolpack module and for removing formed can bodies in use. The infeed-discharge module may be removable in order to allow removal and attachment of the toolpack module.

The components of the can bodymaker may include a ram and a punch fixed to an end of the ram. The can bodymaker may comprise a mechanism for aligning the ram and the punch relative to the can bodymaker.

According to a second aspect of the invention there is provided a toolpack module for use with a can bodymaker. The can bodymaker comprises a plurality of components that require relative alignment to one another, the components including one or more dies. The toolpack module comprises: a frame; an adjustment mechanism for supporting the die(s) in the frame and adjustably aligning the die(s) with respect to the frame when the toolpack module is not attached to the bodymaker; and one or more fixing features for enabling removable fixing of the toolpack module to the can bodymaker.

The toolpack module may comprise a redraw sleeve module which is configured to align a redraw sleeve with the toolpack frame. The redraw sleeve module is coupled to the toolpack frame and has one or more bearings defining a passage through which the redraw sleeve moves. The redraw sleeve module has a bearing adjustment mechanism to facilitate radial alignment of the redraw sleeve module with the toolpack frame.

The toolpack module may comprise a pair of wear bars attached to the toolpack frame and arranged to support said one or more dies. The die(s) are alignable with respect to the toolpack frame by adjusting one or both of said wear bars.

The toolpack module may comprise a redraw sleeve module configured to align a redraw sleeve with the toolpack frame. The redraw sleeve module is coupled to the toolpack frame and has one or more bearings defining a passage through which the redraw sleeve moves. The redraw sleeve module has a bearing adjustment mechanism to facilitate radial alignment of the redraw sleeve module with the toolpack frame.

According to a third aspect of the present invention there is provided a domer module for use with a can bodymaker. The can bodymaker comprises a plurality of components that require relative alignment to one another, the components including a bottom forming tool. The domer module comprises a frame; an adjustment mechanism for supporting the bottom forming tool in the frame and adjustably aligning the bottom forming tool with respect to the frame when the domer module is not attached to the bodymaker; and one or more fixing features for enabling removable fixing of the domer module to the can bodymaker.

According to a fourth aspect of the present invention there is provided a module for a can bodymaker. The can bodymaker comprises a plurality of components that require relative alignment to one another. The module comprises: a frame; an adjustment mechanism for supporting at least one component of the plurality of components in the frame and adjustably aligning the component with respect to the frame when the module is not attached to the bodymaker; and one or more fixing features for enabling removable fixing of the module to the can bodymaker.

The fixing features may be configured to interact with the can bodymaker to provide a single-point fixing, for example a zero-point clamp.

According to a fifth aspect of the present invention there is provided a method of setting up a can bodymaker. The can bodymaker comprises a plurality of components that require relative alignment to one another. The method comprises the steps of: coupling one or more components, including at least a die, to a toolpack frame to form a toolpack module; aligning the one or more components with respect to the toolpack frame; and releasably installing the toolpack module into the can bodymaker.

The die may be a draw die or an ironing die, and the one or more components may include one or more of a draw die, ironing die, a cup holder, a redraw sleeve and a stripper.

The method may comprise: configuring one or more further modules, each further module having a further frame, by coupling one or more of said plurality of components to each of the further frames; for each further module, aligning the one or more of said components with respect to the further frame; and releasably installing each of the further modules into the can bodymaker.

The method may comprise attaching the/or each module to an alignment test bed prior to aligning the one or more components of the/or each module, the alignment test bed having fixings corresponding to fixings of the can bodymaker.

Also described is a can bodymaker comprising components that require relative alignment to one another, the can bodymaker comprising a toolpack module including a toolpack frame supporting two or more of said components including one or more dies, the two or more components being alignable with respect to the toolpack frame when the toolpack module is not attached to the bodymaker, the can bodymaker further comprising a fixing that allows removable fixing of the toolpack module to the can bodymaker.

Also described is a method of setting up a can bodymaker, the can bodymaker comprising components that require relative alignment to one another, the method comprising the steps of: coupling two or more components, including at least a die, to a toolpack frame to form a toolpack module; aligning the two or more components with respect to the toolpack frame; and releasably installing the toolpack module into the can bodymaker.

DETAILED DESCRIPTION

A known can bodymaker 1 has been briefly described above with reference to FIG. 1. The box with a dashed outline in FIG. 1 encloses a number of alignable components 5, 22, 24 of the known can bodymaker that might, for example, be included in the toolpack module described below.

Figure 2:
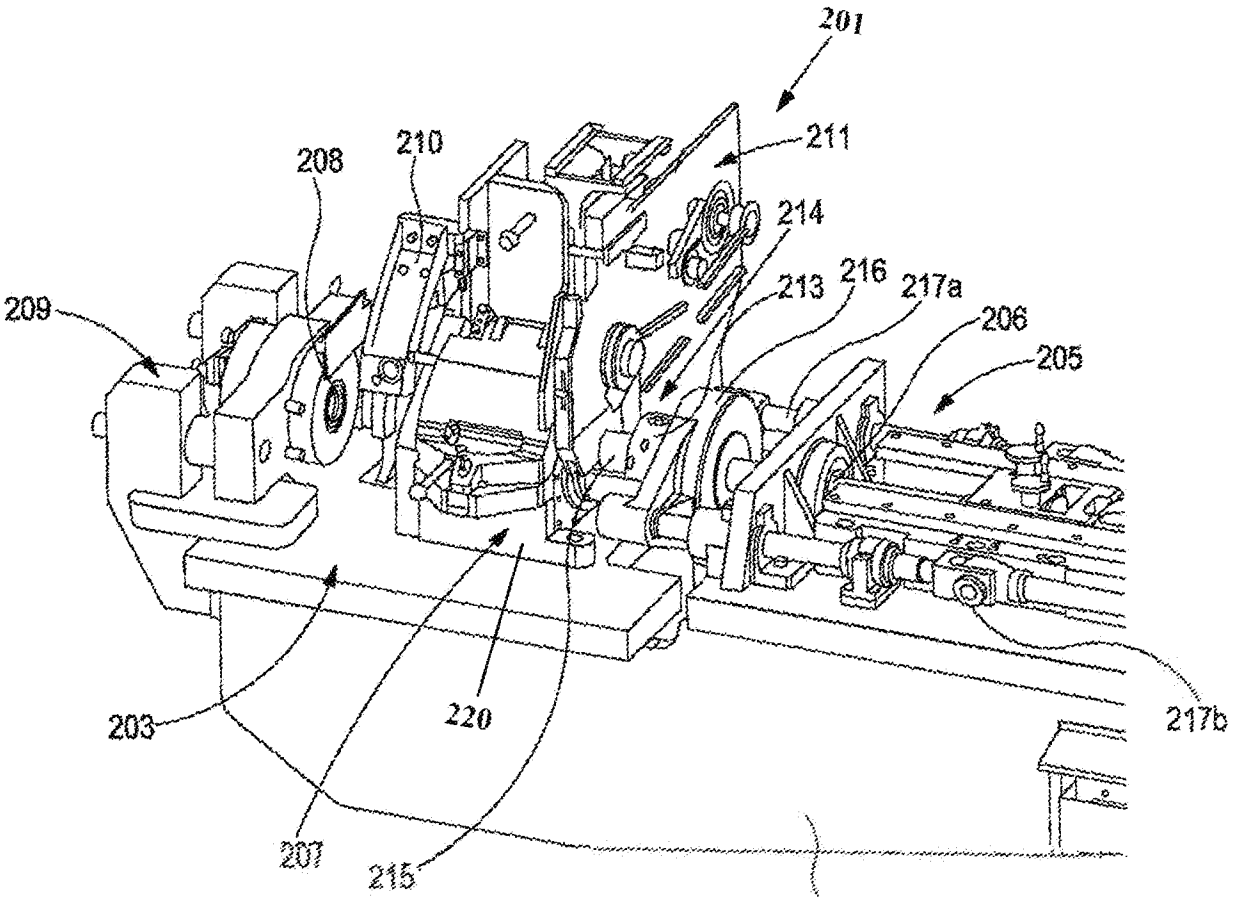
FIG. 2 is a perspective schematic view of a modular bodymaker according to an embodiment of the invention.

FIG. 2 is a perspective schematic view of a modular bodymaker 201 for making can bodies from cups drawn from sheet metal. The bodymaker 201 comprises a base 202 which supports a machine bed 203 with a datum surface 204 and a ram assembly 205. The ram assembly 205 comprises a reciprocating ram 206 with a punch (not shown) mounted on one end. During a forward stroke of the bodymaker 201, the punch contacts a cup (not shown) held in the path of the ram within a toolpack module 207 located on the datum surface 204. The punch pushes the cup through a redraw die (not shown) contained within the toolpack module 207 to form an elongated can body. The can body is carried on the punch to contact a bottom forming tool 208 housed by a domer module 209 so as to form a shape such as dome on the base of the can. On a return stroke of the bodymaker 201, the can body is removed from the punch by a stripper (not shown) of the toolpack module 207. The can body is transported away from the ram axis by a can discharge turret 210 of an infeed-discharge module 211 located between the toolpack module 207 and the domer module 209.

The toolpack module 207 includes a toolpack frame 220 and one or more of a plurality of components of the can bodymaker 201 including one or more dies supported by the toolpack frame 220. The toolpack module 207 also comprises a redraw sleeve module 212, located in front of the redraw die (not shown) for positioning the cup during the redraw process. The redraw sleeve module 212 comprises a bearing 213 with a cup locator (not shown) to receive a cup from an infeed mechanism 214 of the infeed-discharge module 211. The bearing 213 supports a reciprocating redraw sleeve 215 which is aligned coaxially with the ram and has a central bore which allows the punch to pass therethrough. A rear end of the redraw sleeve 215 is coupled to a redraw carriage 216 which is driven in a reciprocating motion by a pair of push rods 217*a*, 217*b* located on opposite sides of the ram 206. Prior to the punch contacting the can, the redraw sleeve 215 enters the open end of the cup and forces the cup into contact with the redraw die. The redraw sleeve 215 holds the cup firmly in place against the redraw die as the punch pushes the cup through an aperture of the redraw die which is of smaller diameter than the cup. As the cup is drawn through the redraw die by the punch it reduces in diameter and its sidewall lengthens. The toolpack module 207 may also contain one or more ironing dies or other tooling for forming the can body after the redraw die. The punch then carries the elongated cup away from the redraw sleeve module and through the remaining ironing dies and tooling.

Figure 3:
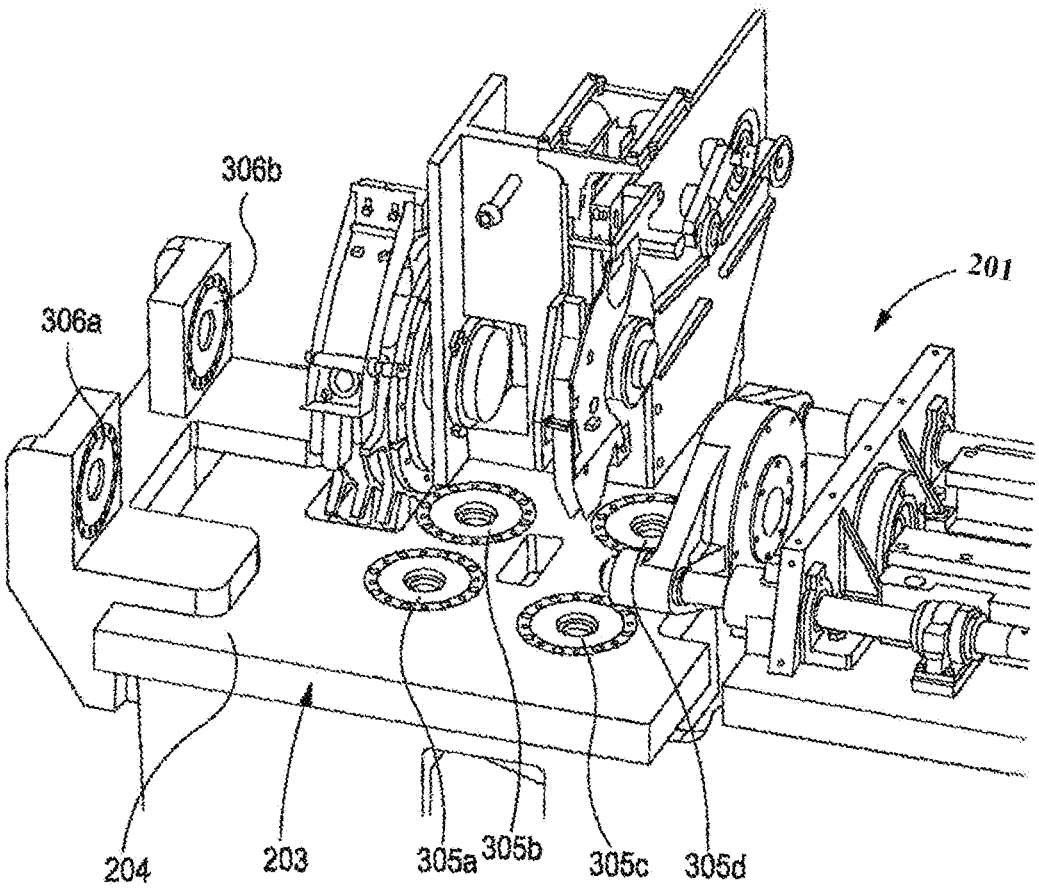
FIG. 3 is a perspective view of the bodymaker of FIG. 2 with a number of modules removed.
Figure 4:
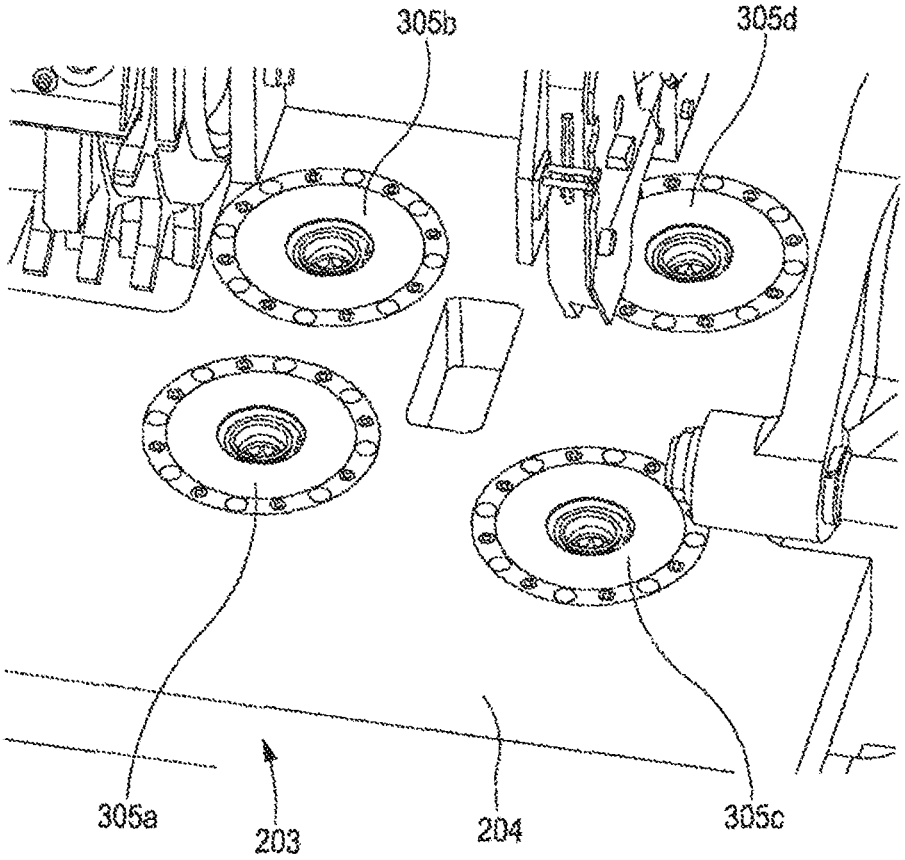
FIG. 4 is a perspective view of the machine bed of FIGS. 2 and 3 showing the precision mounts.

FIG. 3 is a perspective schematic view of the bodymaker 201 with the toolpack and domer modules removed. Precision mounts 305*a-d*, 306*a,b* are attached to the machine bed 203 for fixing the modules to the bodymaker 201. The precision mounts 305*a-d*, 306*a,b* allow the toolpack module 207 and the domer module 209 to be removed from the bodymaker and replaced in substantially the same position on the datum surface. For example, the precision mounts 305*a-d*, 306*a,b* may allow the modules to be replaced with a positional accuracy better than 10 μm. The mounting means may comprise zero point clamps, in which case the positional accuracy may be better than 5 μm. The various precision mounts for the modules define respective datum positions, relative to the datum surface 204. FIG. 4 is a perspective schematic view of the machine bed 203 showing the precision mounts 305*a-d*.

Figure 5:
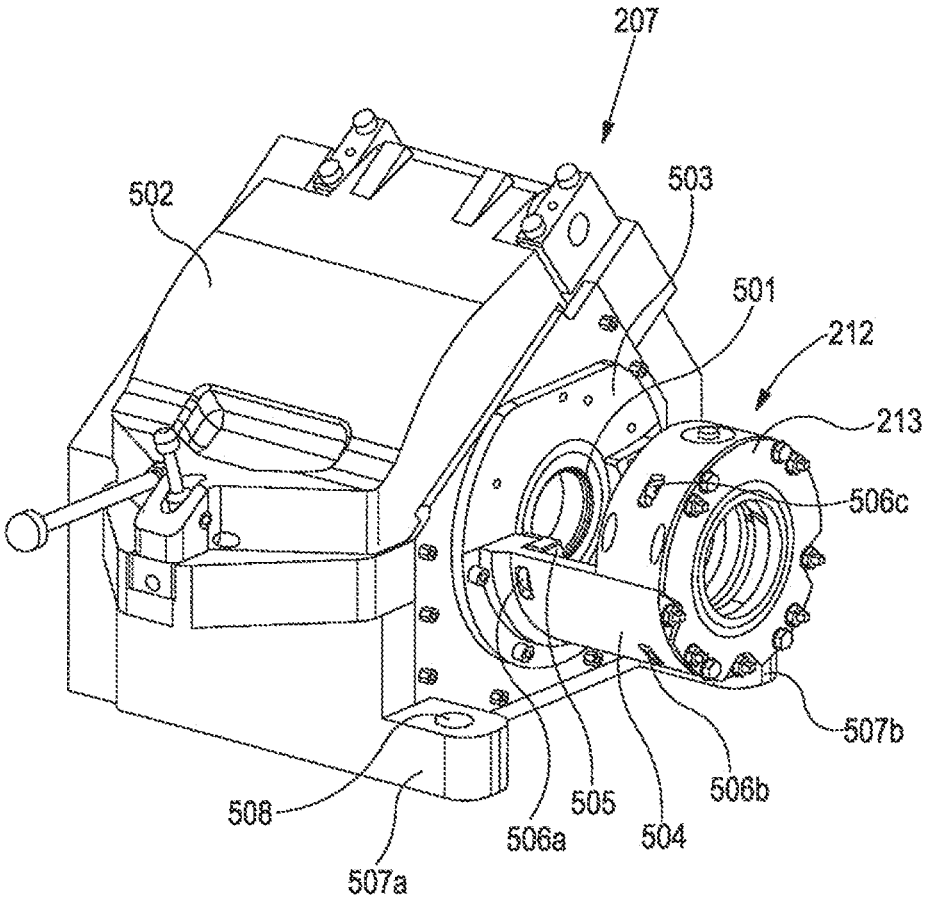
FIG. 5 is a perspective view of the toolpack module of FIG. 2.

FIG. 5 is a perspective schematic view of the removable toolpack module 207. The toolpack module 207 houses the redraw die 501 and the ironing dies (not shown) and other tooling that may be required for forming the can body. The interior of the toolpack module 207 is accessed by lifting a hinged lid 502. The redraw sleeve module 212 comprises a flange 503 bolted to the front of the toolpack module 207 and a bracket 504 which supports the cup locator 505 and the bearing 213. The redraw sleeve module 212 comprises a set of adjustable cams 506*a-c* for aligning the cup locator 505 and the bearing 213 with respect to the redraw die 501. A pair of feet 507*a,b* extend horizontally from the base of the toolpack module 207. Each foot 507*a,b* has a hole 508 passing vertically through to allow the feet 507*a,b* to be positioned over a corresponding pair of precision mounts 305*c,d* when the toolpack module 207 is installed on to the datum surface 204.

Figure 1:
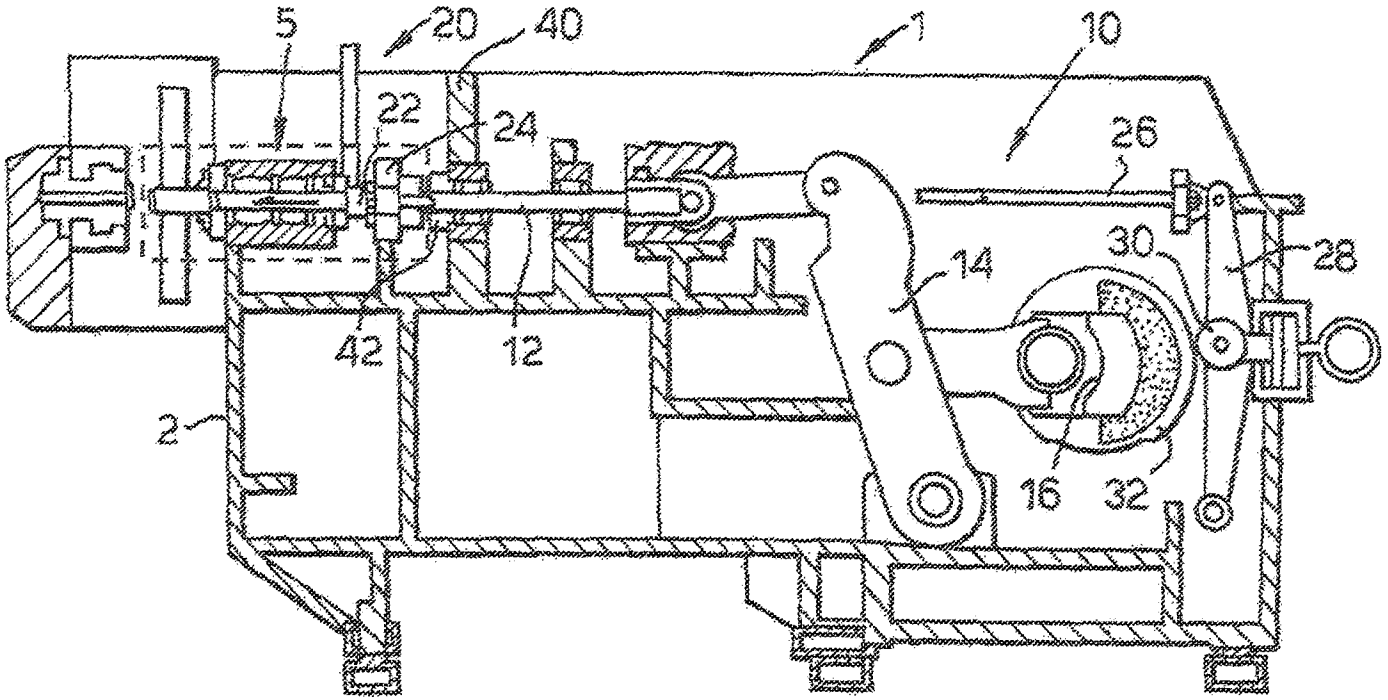
FIG. 1 shows schematically a known can bodymaker.
Figure 6:
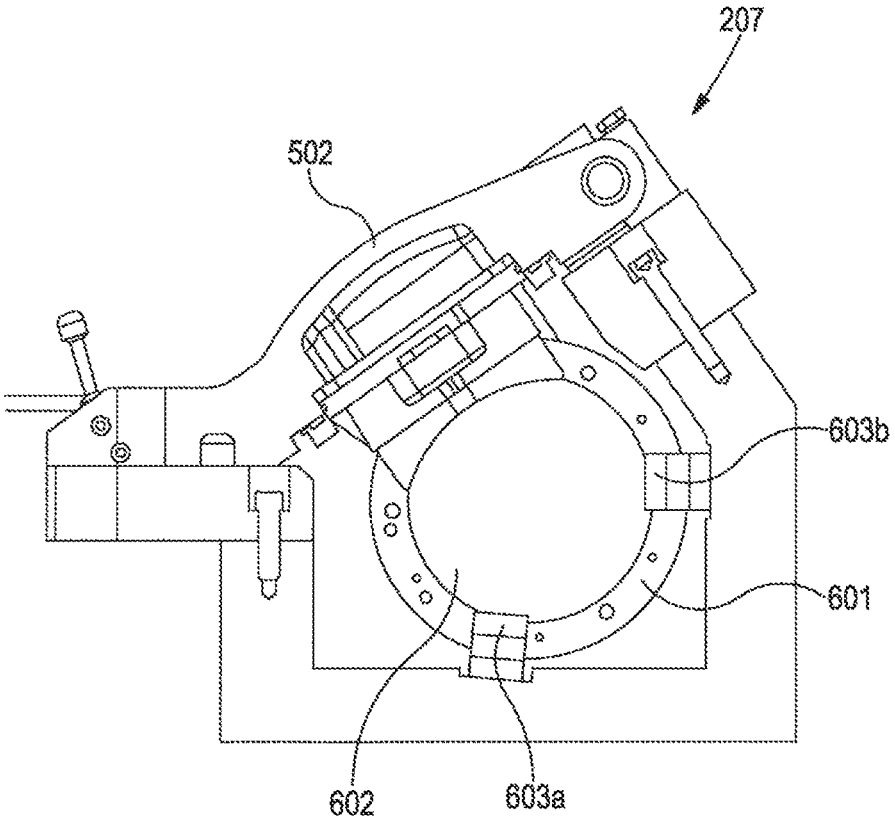
FIG. 6 is a section view of the toolpack module of FIGS. 2 and 5.

FIG. 6 is a schematic cross-sectional view of the toolpack module 207 looking along the axis defined by the ram 206 in FIG. 1. The toolpack module 207 comprises a die holder 601 mounted securely within the toolpack module body 207. The die holder 601, in combination with the lid 502, defines a generally cylindrical cavity 602 in which to accommodate the redraw die 501 and ironing dies (not shown). Each die is fixed within a cylindrical holder (not shown) which fits the die holder 601 closely whilst leaving a small amount of room for adjustment. Cylindrical spacers (not shown) are inserted between the die holders to position the dies along the axis of the die holder 601. When the bodymaker 201 is used, the spacers may be actively cooled, e.g. by pumping a coolant through them, to dissipate heat generated by the DWI process.

The die holder 601 comprises a pair of wear bars 603*a,b* mounted within the interior wall of the die holder 601 and extending parallel to the axis of the die holder 601. The wear bars 603*a,b* protrude into the cylindrical cavity 602 by a small distance so that, when the ironing dies and cylindrical spacers are installed, they are supported by the wear bars 603*a,b*. The dies and cylindrical spacers may be locked in place by closing the lid 502. During set up of the bodymaker 201 the radial positions of the dies and spacers relative to the axis of the die holder 601 may require adjusting. This adjustment can be carried out by machining the wear bars 603*a,b*, e.g. by grinding, or by inserting one or more shims between the wear bars 603*a,b* and the die holder 601. The wear bars 603*a,b* are separated by an angle of about 90° around the circumference of the cylindrical cavity 602 to allow orthogonal adjustments to be made.

Operation of the bodymaker 201 requires accurate alignment of the redraw sleeve module 212, the redraw die, ironing dies, the stripper and any other tooling of the toolpack module 207 with respect to a common axis. The bottom forming tool 208 of the domer module 209 must also be aligned to the same axis. The alignment of the various components may be performed using a laser alignment system. For example, collimated laser light can be directed along the common axis and the radial positions of the components adjusted to ensure they are centred. As an example, the stripper may be adjusted manually by loosening a series of screws which fix it to the bodymaker 201. A datum target may be mounted on each of the components to clearly define the centre of the component, e.g. by providing a small aperture through which the laser light can pass.

Reconfiguring the bodymaker 201 to produce cans with a different diameter requires many of the components of the two modules to be replaced and the new components realigned. For example, larger diameters would require a redraw die with a larger aperture to be installed in the toolpack module 207 and aligned with the common, central axis of the bodymaker. The bottom forming tool 208 or "dome die" of the domer module 209 may also need to be replaced, together with other possible components of the domer module 209, such as the dome die spacer (not shown) and the hold down ring (not shown). The domer module 209 contains an adjustment mechanism (not shown) which allows the bottom forming tool 208 to be positioned relative to the frame of the domer module 209.

The modular design of the bodymaker 201 reduces the time required for a changeover to a different can diameter or other bodymaker settings. For example, while the bodymaker 201 is producing cans of one diameter, a separate toolpack module 207 and domer module 209 may be pre-aligned for a different can diameter. The pre-alignment of the toolpack module 207 and domer module 209 may be carried out on a separate alignment bed provided with mounting means configured to have a layout identical to that of the bodymaker 201. During changeover, the pre-aligned toolpack module 207 and domer module 209 may be mounted in position on the datum surface 204 relatively quickly. Little or no realignment of the toolpack 207 or domer 209 modules may be necessary.

There may be multiple modules for use with a particular bodymaker 201. For example, there may be multiple toolpack modules 207, each configured for a different can size. To help distinguish between the modules, the modules and the bodymaker 201 may be provided with identifying tags, such as RFID tags. Alternatively, a "Poka Yoke" type mechanism may be used to prevent a wrong combination of modules 207, 209 from being installed into the bodymaker 201.

The modular design of the bodymaker 201 may also allow fast replacement of the toolpack 207 and/or domer 209 modules in the event of damage, for servicing, or to reduce wear.

The infeed-discharge module 211 may be fitted with quick fix mechanisms to allow the can discharge turret 210 and the infeed mechanism 214 to be removed and replaced during changeover.

Figure 7:
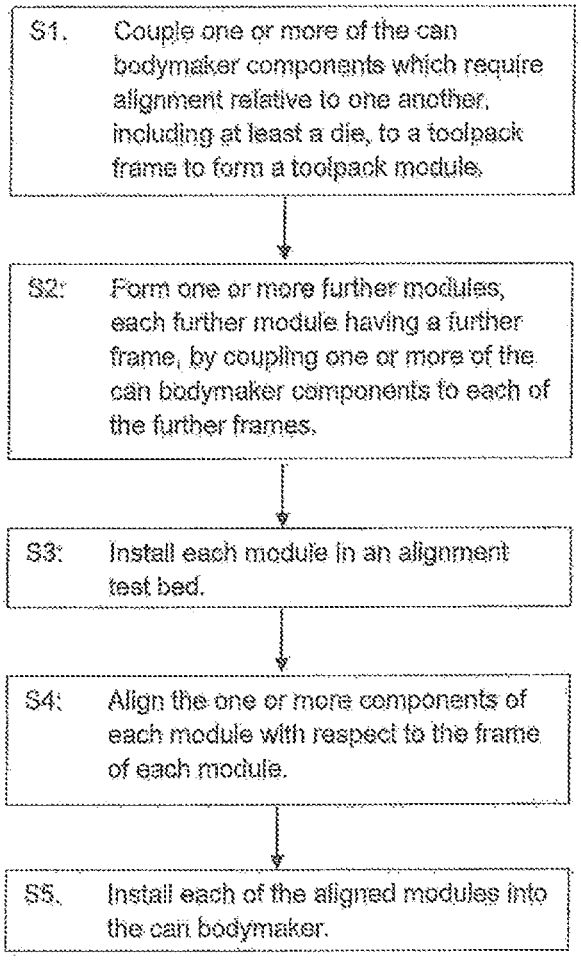
FIG. 7 is a flow chart illustrating a method of setting up the modular bodymaker of FIG. 3.

FIG. 7 is a flow chart illustrating a method of setting up the modular bodymaker of FIG. 2. The first step S1 of the method is to form a toolpack module by coupling one or more of the can bodymaker components which require alignment relative to one another, including at least a die, to a toolpack frame. One or more further modules, each with a further frame, may be formed in a second step S2 by coupling one or more of the can bodymaker components to each of the further frames. Each of the modules is then installed S3 into an alignment test bed. The one or more components of each module are then aligned S4 with respect to the frame of each module, e.g. using a ram attached to the alignment test bed. The aligned modules are then installed S5 into the can bodymaker.

An alternative method of setting up the modular bodymaker of FIG. 2 involves in situ alignment of one or more of the modules. For example, the toolpack module may be aligned whilst it is installed into the can bodymaker, i.e. one or more of the components may be coupled to the toolpack frame (before or after the toolpack frame is installed into the can bodymaker) and aligned with respect to the toolpack frame without removing the toolpack frame from the can bodymaker. Once the in situ alignment has been carried out, the module(s) can be removed and then later re-installed into the can bodymaker without needing re-alignment, or possibly requiring only minor re-alignment, of the module(s).

If the modules are aligned in situ then a separate alignment test bed may not be required. Nevertheless, a separate alignment test bed allows at least one of the modules to be removed from the can bodymaker and aligned whilst the remaining modules are aligned in situ. This approach may be used to speed up the alignment process as the modules can be aligned separately in parallel, e.g. by multiple workers simultaneously.

It will be appreciated by the person of skill in the art that various modifications may be made to the above described embodiments without departing from the scope of the invention.

The invention claimed is:

1. A can bodymaker comprising:

a ram assembly;

a removable first tool pack module adapted for receiving a ram of the ram assembly to elongate can bodies; the first tool pack module consisting of a first tool pack frame, a plurality of first dies that require alignment relative to one another, a first redraw sleeve module including a first redraw sleeve, one or more first fixings adapted for enabling removable fixing of the first tool pack module to the can bodymaker in a datum position; the plurality of first dies supported by the first tool pack frame, each one of the plurality of first dies being alignable with respect to the first tool pack frame and with respect to other ones of the plurality of first dies when the first tool pack module is spaced apart from the can bodymaker, a removable second tool pack module adapted for receiving the ram of the ram assembly to elongate can bodies; the second tool pack module consisting of a second tool pack frame, a plurality of second dies that require alignment relative to one another, a second redraw sleeve module including a second redraw sleeve, one or more second fixings adapted for enabling removable fixing of the second tool pack module to the can bodymaker in the datum position; the plurality of second dies supported by the second tool pack frame, each one of the plurality of second dies being alignable with respect to the second tool pack frame and with respect to other ones of the plurality of second dies when the second tool pack module is spaced apart from the can bodymaker, wherein the first fixings and the second fixings are precision mounts, and whereby the second tool pack module, having the plurality of second dies mutually pre-aligned, is adapted for replacing the first tool pack module, upon removal of the first tool pack module from the bodymaker, by positioning the second toolpack module in the datum position, thereby enabling assembly of the second tool pack module into the can bodymaker after alignment of the plurality of second dies relative to each other and to the second tool pack frame.

2. The can bodymaker according to claim 1, wherein said plurality of second dies includes a draw die or an ironing die, the can bodymaker further comprises one or more of other draw dies, an ironing die, a cup holder, a redraw sleeve and a stripper, each of which are coupled to and alignable to the second toolpack frame.

3. The can bodymaker according to claim 1, wherein said second toolpack module comprises a pair of wear bars attached to said second toolpack frame and arranged to support said plurality of second dies, said plurality of second dies being alignable with respect to said second toolpack frame by adjusting one or both of said wear bars.

4. The can bodymaker according to claim 1, wherein the second redraw sleeve module is configured to align the second redraw sleeve with the second tool pack frame, the second redraw sleeve module being coupled to the second tool pack frame and having one or more bearings defining a passage, the second redraw sleeve being sized to move through the passage, the second redraw sleeve module having a bearing adjustment mechanism to facilitate radial alignment of the second redraw sleeve module with the second tool pack frame.

5. The can bodymaker according to claim 1 further comprising one or more further removable toolpack modules, each further removable toolpack module having one or more of a plurality of components coupled to a frame of the further removable toolpack module, the one or more of said plurality of components being alignable with respect to the further removable toolpack frame when the further removable toolpack module is spaced apart from the can bodymaker, the can bodymaker further comprising a further precision mount for each further removable toolpack module that allows removable fixing of the further removable toolpack module to the can bodymaker.

6. The can bodymaker according to claim 5, wherein the one or more further removable toolpack modules comprises a domer module frame, and the one or more of said plurality of components includes a bottom forming tool coupled to the domer module frame.

7. The can bodymaker according to claim 1, wherein each precision mount is a single-point fixing comprising a zero-point clamp.

8. The can bodymaker according to claim 1 wherein, using the precision mounts, each removable tool pack module is removably fixed to the can bodymaker within 10 μm of a desired location of the tool pack module.

9. The can bodymaker according to claim 1 and further comprising an infeed-discharge module for delivering cups or other preform articles to the removable second toolpack module and for removing formed can bodies, the infeed-discharge module being removable in order to allow removal and attachment of the removable second toolpack module.

10. The can bodymaker according to claim 1, wherein said ram assembly includes the ram and a punch fixed to an end of the ram.

11. A tool pack module for use with a can bodymaker, the tool pack module consisting of:

a tool pack frame;

a plurality of dies and a plurality of die holders, each one of the plurality of dies being fixed within a corresponding one of the die holders, the dies being adjustable and alignable with respect to the die holders in the tool pack frame and with respect to other ones of the plurality of dies when the tool pack module is spaced apart from the can bodymaker;

a redraw sleeve module including a redraw sleeve; and one or more fixings adapted for enabling removable fixing of the tool pack module to the can bodymaker in a datum position;

whereby the tool pack frame is adapted for locating in the datum position on the fixings while the plurality of dies is pre-aligned relative to one another and the tool pack frame.

12. The toolpack module according to claim 11, wherein each one of the die holders comprises a pair of wear bars arranged to support said plurality of dies, the plurality of dies being alignable with respect to said toolpack frame by adjusting one or both of said wear bars.

13. The toolpack module according to claim 11, wherein the redraw sleeve module is configured to align the redraw sleeve with the toolpack frame, the redraw sleeve module being coupled to the toolpack frame and having one or more bearings defining a passage through which the redraw sleeve moves, the redraw sleeve module having a bearing adjustment mechanism to facilitate radial alignment of the redraw sleeve module with the toolpack frame.

14. A method of setting up a can bodymaker, the method comprising the steps of:

providing toolpack module according to claim 11;

coupling each of the plurality of dies to the frame; and aligning each one of the plurality of dies with respect to the tool pack frame and with respect to other ones of the plurality of dies;

releasably installing the tool pack module into the can bodymaker in the datum position after the step of aligning the dies.

15. The method according to claim 14, wherein said plurality of dies includes a draw die or an ironing die, and one or more of a draw die, an ironing die, a cup holder, a redraw sleeve and a stripper.

16. The method according to claim 14 and further comprising:

configuring one or more further toolpack modules, each further toolpack module having a further frame, by coupling one or more further plurality of dies to each of the further frames;

for each further module, aligning the one or more of said dies with respect to the further frame; and releasably installing each of the further toolpack modules into the can bodymaker interchangeably.

17. The method according to claim 14, wherein prior to the step of aligning each one of the plurality of dies, the method further comprising attaching the toolpack module to an alignment test bed, the alignment test bed having precision mounts corresponding to precision mounts of the can bodymaker.

* * * * *